United States Patent [19]

Chung et al.

[11] 4,128,064

[45] Dec. 5, 1978

[54] FREE STANDING SHELVES

[76] Inventors: Ming-To Chung; Ming-Sum Chung, both of Apt. #511, 670 Parliament St., Toronto, Ontario, Canada

[21] Appl. No.: 832,748

[22] Filed: Sep. 12, 1977

[51] Int. Cl.[2] ..... A47B 3/00

[52] U.S. Cl. ..... 108/111; 108/144; 248/188

[58] Field of Search ..... 108/107, 110, 111, 144; 211/186, 187; 248/188, 250

[56] References Cited

U.S. PATENT DOCUMENTS

| | | | |
|---|---|---|---|
| 1,265,373 | 5/1918 | Philip | 211/187 X |
| 2,222,160 | 11/1940 | Walsh | 108/111 |
| 3,424,111 | 1/1969 | Maslow | 108/144 |
| 3,675,598 | 7/1972 | Kesilman et al. | 108/144 |
| 3,757,705 | 9/1973 | Maslow | 108/144 |
| 3,853,074 | 12/1974 | Madey | 108/111 X |

*Primary Examiner*—James C. Mitchell

[57] ABSTRACT

A shelf structure comprises a plurality of interconnected posts and shelves. Spaced apart annular recesses or ribs are provided on the posts for positive engagement with corresponding ribs or recesses respectively formed on the insides of multi-piece collars which are placed in position about the posts. A fastening ring either slips over the collar or is screwed upwardly onto the collar to lock it into position and to provide an upwardly facing shelf-supporting surface. Shelf-clamping rings are then screwed downwardly on the collars to abut the top surfaces of the shelves.

15 Claims, 7 Drawing Figures

FREE STANDING SHELVES

The invention relates to free standing shelves, such as are used, for example, as room dividers, furniture, display shelves and the like.

BACKGROUND OF THE INVENTION

Shelving systems which are intended to be free standing, i.e., standing erect in a room, as an article of furniture, without being supported on a wall, require a certain combination of different features and characteristics. Such features include a high degree of rigidity normally achieved only with a relatively heavy framework and high degree of flexibility in arrangement, which is usually incapable of being achieved to any degree if a rigid framework is provided. In addition, it is desirable that the shelves may be open on all sides for free access from any direction free of any cross-bracing which would further reduce the possibility of providing some form of rigid support.

In addition to all these features, it is of course essential that the shelving shall have an attractive decorative appearance, so that it may be incorporated in the furnishing scheme of a room without detracting from its appearance.

In the past, various shelving systems have been proposed which would satisfactorily meet one of these criteria but were, generally speaking, incapable of satisfying all of these requirements at the same time. Many such prior art systems involved the use of solid posts having holes or notches and shelves being fastened in position with various screw fasteners or special tools. Other designs depended upon purely frictional engagement which could mar the surface of the posts when the shelving was rearranged into a new layout.

The present invention takes into consideration all these criteria and provides a shelving system of an appealing design, capable of being arranged in a flexible manner without the use of tools, to provide shelves at different heights, and at the same time providing a rigid self-supporting system.

Broadly, the present invention provides a shelf structure which comprises a shelf including an opening; a post extending freely through said opening and having a plurality of first abutment means mutually spaced apart and on said post; and a shelf-supporting and clamping means releasably engaged with said post and which in turn comprises a collar surrounding said post; a second abutment means on said collar and engaging one of said plurality of first abutment means on said post whereby said collar is securely held in a fixed position relative to said post; a fastening means removably encircling said collar so as to maintain said second abutment means and said one of said plurality of first abutment means in engagement with each other; a shelf-supporting surface on said fastening means and in supporting juxtaposition with an undersurface of said shelf; and a shelf-clamping means releasably abutting a top surface of said shelf to clamp said shelf between said clamping means and said fastening means.

In general, a shelf structure in accordance with this invention will comprise at least three posts and at least two shelves, each of which is connected to each said post by a shelf-supporting and clamping means as already defined.

The collar provided in the shelf-supporting and clamping means of a shelf structure in accordance with this invention is usefully in the form of a split collar formed of two generally semi-cylindrical portions which fit around a post to make an essentially complete collar.

In one embodiment of the invention, the first abutment means as provided on the posts are in the form of annular peripheral grooves spaced apart along the post for engagement by cooperating annular ribs projecting inwardly from the collar of the shelf-supporting and clamping means. Alternatively, such first abutment means can be in the form of annular radially outwardly projecting ribs extending around the posts at spaced intervals therealong, and the two-piece annular collars used will then be provided with cooperating internal annular recesses for fitting over such ribs.

The fastening means provided in a shelf-supporting and clamping means of a shelf structure in accordance with this invention may be in the form of a ring which encircles the collar to hold that collar in position on a post and to provide the upwardly facing shelf-supporting surface. Alternatively, such a fastening means may be in the form of an internally threaded annular member or ring having an upwardly facing shelf-supporting surface and which screws upwardly onto the lower threaded end of the collar. Such can serve to hold the pieces of a multi-piece collar in their correct position and can be used to cause radially inward flexing of the lower end of the collar into tight clamping engagement with the post or even into a selected one of a series of annular recesses formed in the post.

Where cooperating ribs and recesses are formed on the collars and the posts, the collars are usefully provided with a skirt portion which is formed with elongated slits so that those skirt parts can readily be flexed into tight compression fit with the posts. Such inward flexing can be effected using an internally threaded fastening ring as previously mentioned or by the provision of cooperating cam surfaces on the collar and a non-threaded fastening ring.

The shelf-clamping means provided in the shelf-supporting and clamping means of a shelf structure in accordance with this invention is usefully in the form of an internally threaded annular member or ring which is screwed downwardly on mating threads provided at the upper end of the collar so that the shelf is finally firmly and rigidly clamped between the shelf-supporting means and such shelf-clamping means so allowing the shelf structure to be moved as a whole without risk of movement of the shelves relative to the posts. Such threaded clamping rings can also serve indirectly to cause the aforesaid desirable radially inward flexing of the collar skirt parts.

It will of course be understood that the same shelf-supporting and clamping means are provided on all posts at the same height, so as to provide for secure engagement of the shelf at all points.

Preferably, all the shelves will be of rectangular shape, although they may equally well have other shapes, for example, elliptical shape, or indeed any other shape, even circular, if desired.

The shelving may of course be extended simply by increasing the multiples of posts.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will now be described merely by way of illustration with reference to the accompanying drawings, in which.

DESCRIPTION OF THE PREFERRRED EMBODIMENTS

Figure 1:
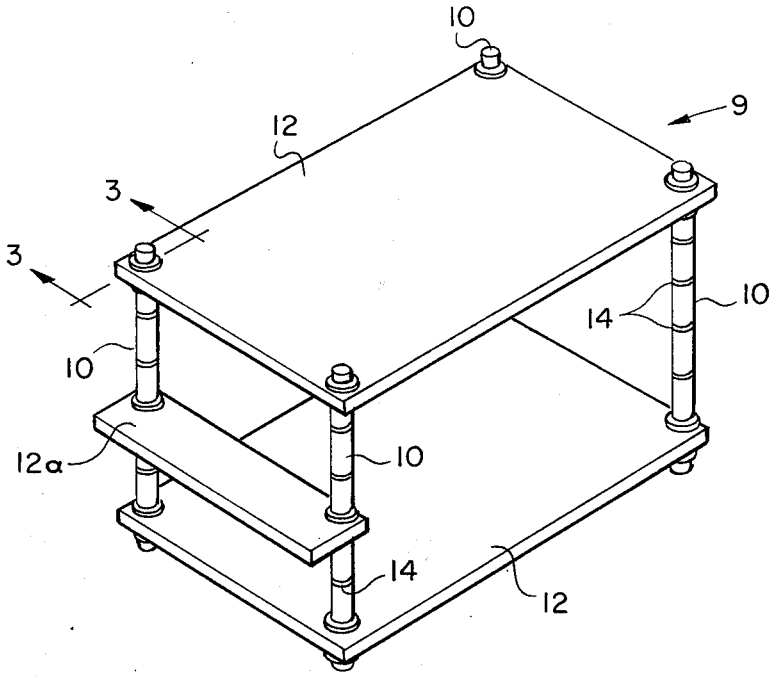
FIG. 1 is a perspective view of one embodiment of a shelf structure in accordance with this invention.

Referring first of all to FIG. 1, it will be seen that the invention as illustrated therein provides a shelf structure generally indicated at 9 and which comprises a plurality of identical posts 10 and a plurality of shelves 12.

While the shelves 12 are shown in FIG. 1 as each having an elongated rectangular configuration, it will, of course, be appreciated that this invention embraces shelf structures in which the shelves have other shapes. For example, the individual shelves of such a structure can be square, circular, elliptical, triangular or of other regular or irregular configuration.

Similarly, while the shelf structure 9 is shown in FIG. 1 as comprising four posts 10, it will be understood that the invention equally embraces shelf structures including more or less than four such posts. For example, it will be noted that there is shown in FIG. 1 at 12*a* a modified shelf which is supported on only two of the posts 10.

Figure 2:
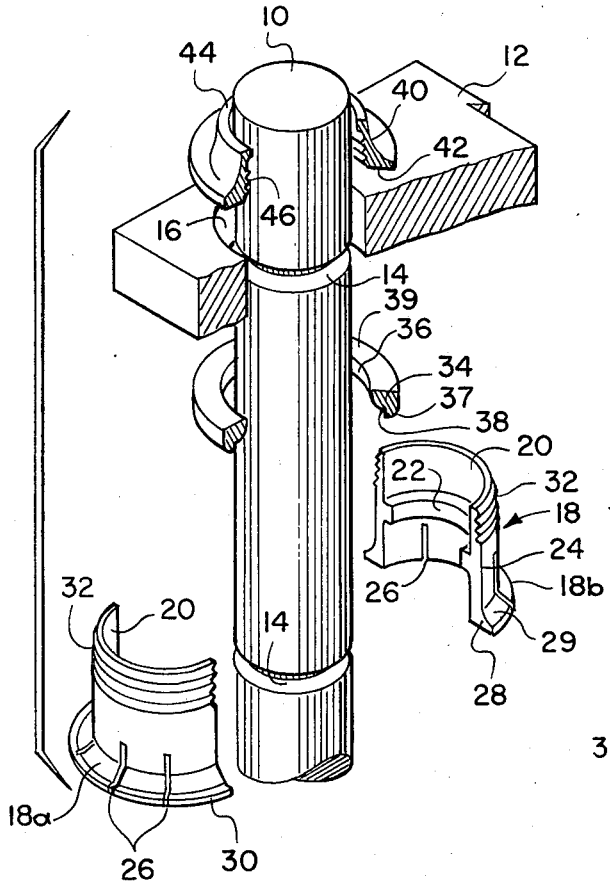
FIG. 2 is an exploded perspective view of one corner of the shelf structure shown in FIG. 1.

From FIGS. 1 and 2, it will be seen that each of the posts 10 is, in the embodiment illustrated therein, formed with a plurality of mutually spaced encircling peripheral recesses 14 which constitute the aforementioned first abutment means. While the recesses 14 are shown in FIG. 1 as being equally spaced along the posts 10, it will be understood that the spacing between such recesses can vary, provided, of course, that recesses are provided at the same level on all of the posts for supporting one of the shelves 12 between such posts.

While in all the embodiments illustrated in the accompanying drawings, the posts 10 are shown as having regular cylindrical shapes with the recesses 14 being generally circular, it will be understood that the posts could have other configurations. For example, they can have square, rectangular, triangular, elliptical or other sectional configurations and they can even have sculpted shapes with irregular ledges and restrictions provided that such variations do not interfere with the interfitting of the shelves and posts. Similarly, variations in the configurations of the recesses 14 are possible.

Figure 3:
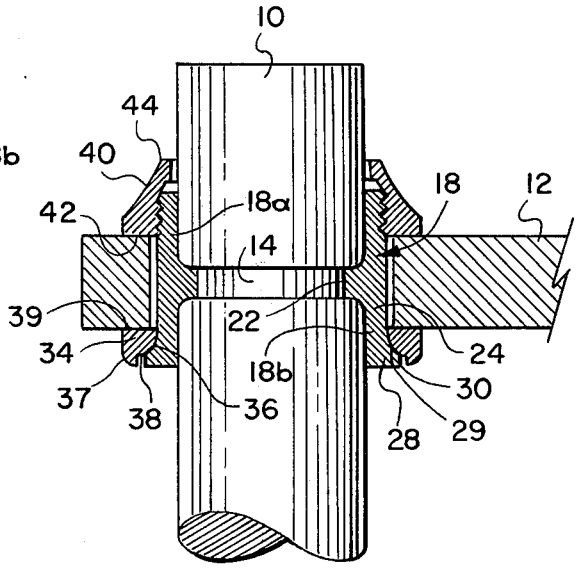
FIG. 3 is a fragmentary sectional view through the shelf structure shown in FIGS. 1 and 2 when taken as indicated by the arrows 3—3 of FIG. 1.

Referring to FIGS. 1, 2 and 3 of the accompanying drawings, it will be seen that each of the shelves 12 is formed with holes or openings 16 which are dimensioned so as to allow the posts 10 to pass freely therethrough.

It is perhaps useful to stress at this juncture that, if the shelves 12 were made somewhat longer than is shown in FIG. 1, such shelves could be provided with six, eight or even more holes 16 so as to permit such a shelf to span several pairs of posts 10. Similarly, while the shelves 12 are shown in FIG. 1 as having the holes 16 provided generally at the corners of such shelves, such holes in any appropriate number can be provided at any other suitable positions on such shelves.

In order to support the shelves 12 on the posts 10, shelf-supporting and clamping means are provided for each of the holes 16 and for releasably engaging with appropriate ones of the aforementioned recesses 14.

In the embodiment shown in FIG. 1, each such shelf-supporting and clamping means comprises a two-piece collar generally indicated at 18 and comprising two generally semi-cylindrical pieces 18*a* and 18*b* having generally semi-cylindrical inner surfaces 20 from which generally semi-annular ribs 22 project radially inwardly and are shaped so as to engage and interfit with a respective one of the recesses 14 when the pieces 18*a* and 18*b* of the collar 18 are disposed in their assembled configuration around and about a respective one of the posts 10. The ribs 22 constitute the aforementioned second abutment means.

While the collar pieces 18*a* and 18*b* are generally semi-cylindrical, they are dimensioned so that, when they are positioned around the post 10 with their ribs 22 disposed within the recess 14, those pieces 18*a* and 18*b* fit snugly about the post 10 since they do not then form a complete cylinder but instead, small longitudinal gaps remain between their opposed longitudinal edges so ensuring a good clamping fit between the collar 18 and the post 10.

The collar 18 has an outside diameter such that, when the pieces 18*a* and 18*b* thereof are fitted snugly about the post 10, such collar may fit loosely into the respective hole 16 in one of the shelves 12.

Each shelf-supporting and clamping means in the embodiment shown in FIGS. 1, 2 and 3 also comprises a fastening means in the form of an annular ring 34 which fits around the collar pieces 18*a* and 18*b* and holds them in their assembled configuration with the ribs 22 disposed in the aforementioned annular recess 14. The ring 34 has an internal diameter such that it may slide over the upper parts of the collar pieces 18*a* and 18*b*.

In order to permit a tight fit of the collar pieces 18*a* and 18*b* around the post 10, the lower portions 24 of those collar pieces are formed with axially extending slits 26 permitting such lower portions to be flexed slightly into a tight grip with the post 10. At their bottom ends, the collar pieces 18*a* and 18*b* are formed with wedge portions 28 having upwardly and outwardly facing cam surfaces 29 terminating in a peripheral outer edge surface 30.

Referrring again to the ring 34, it should be noted that the diameter of that ring is such that when it is slid downwardly about the collar pieces 18*a* and 18*b* with their ribs 22 received in the recess 14, that ring 34 engages the cam surface 29, so that continued downward movement of the ring 34 flexes the lower ends of the collar pieces radially inwardly into tight clamping engagement with the post 10. For this purpose, the ring 34 is formed with a downwardly and inwardly facing annular cam surface 36 which cooperates with the aforementioned cam surfaces 29 to provide the desired wedging action. Optionally, the ring 34 is formed with a peripheral skirt 37 defining an annular notch 38 which receives and conceals the lower and peripheral edge surfaces 30 of the collar pieces 18*a* and 18*b* so in turn to improve the overall aesthetic appearance of the assembly.

The ring 34 has a generally horizontal top surface 39 which serves as a supporting means for the shelf 12 as will readily be understood from FIG. 3. It will now be understood that the external diameter of the ring 34 will be greater than the internal diameter of the opening 16 in the shelf 12.

The peripheral outer edge surface of the ring 34 is usefully knurled or provided with other gripping means (not shown) to facilitate its tightening onto the collar 18.

In order to clamp the shelf 12 in position on the supporting top surface 29 of the ring 34, the collar pieces 18*a* and 18*b* are externally threaded at their upper ends as indicated at 32 for threaded engagement with internal threads 46 of a fastening ring 40, which is formed at its lower end with a flange having an undersurface 42. As the ring 40 constituting a shelf-clamping means is screwed downwardly along the collar pieces 18*a* and 18*b*, the undersurface of that ring presses downwardly against the top surface of the shelf 12 to provide an extremely positive shelf-clamping action. Additionally, such tightening of the ring 40 causes further downward movement of the ring 34 to ensure positive clamping engagement of the collar 18 with the post 10.

The shelf-clamping ring 40 is usefully formed at its upper end with a radially inwardly extending rim 44 which fits over the upper ends of the collar pieces 18*a* and 18*b* to conceal those pieces and again to improve the aesthetic appearance of the assembly. The peripheral edge of the ring 40 is usefully knurled to facilitate its tightening, and removal when required.

A set of shelves such as the shelf structure 9 may be assembled by simply placing four posts 10 in position. A pair of collar pieces 18*a* and 18*b* are then placed around each of the posts 10 with their ribs 22 fitting within the recesses 14 at the desired height. The rings 34 are then slid downwardly over the posts 10 until they engage the cam surfaces 29 of the collar pieces. The shelf 12 is then lowered with the four posts 10 passing through the holes 16. Lowering of the shelf 12 is continued until that shelf is resting on the top surfaces 39 of the rings 34 on all the posts.

At this point, the threads 32 on all the collars 18 will project above the shelf 12 and the shelf-clamping rings 40 are slid downwardly from the top of the posts 10 and screwed onto the threads 32 until they are tightly engaged thereon. At this point, they will be pressing the shelf 12 firmly downwardly so in turn forcing the rings 34 to move downwardly along the cam surfaces 29 and so in turn pressing the skirts 24 of the collar pieces 18*a* and 18*b* tightly against the posts 10.

In this way, a secure and tight engagement is provided between the shelf 12 and the posts 10.

A similar procedure may be followed for the installation of further shelves on the same posts. It will of course be appreciated that more posts can be used to provide a varied and highly flexible arrangement.

The invention will thus be seen to provide a highly flexible shelf structure which may provide shelves at different heights and which may be erected in different sizes. At the same time, the shelf structure of the invention has a pleasing aesthetic appearance and is a secure rigid structure so that no additional bracing or supporting members are needed. In addition, no tools are required for assembling the shelf structure.

Figure 4:
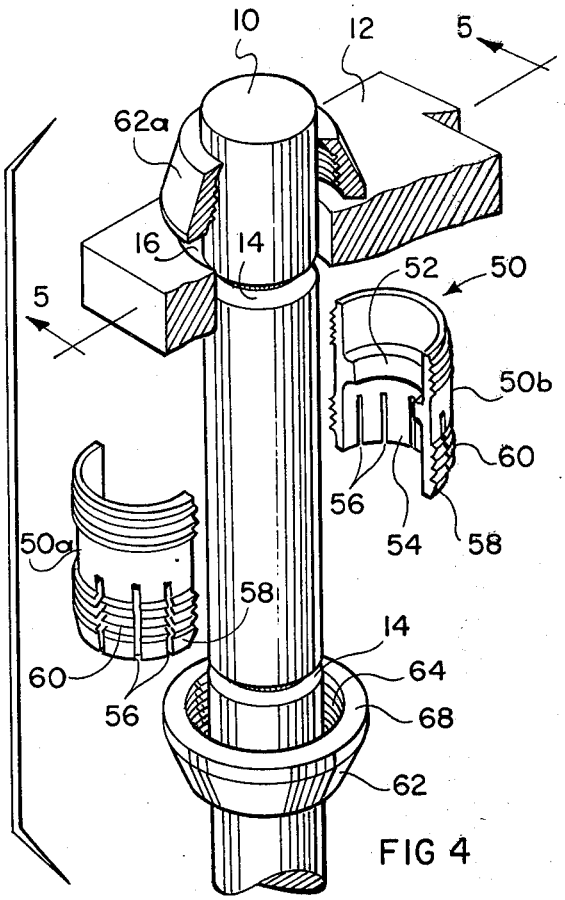
FIG. 4 is an exploded perspective view similar to that of FIG. 2 but showing an alternative embodiment of this invention.
Figure 5:
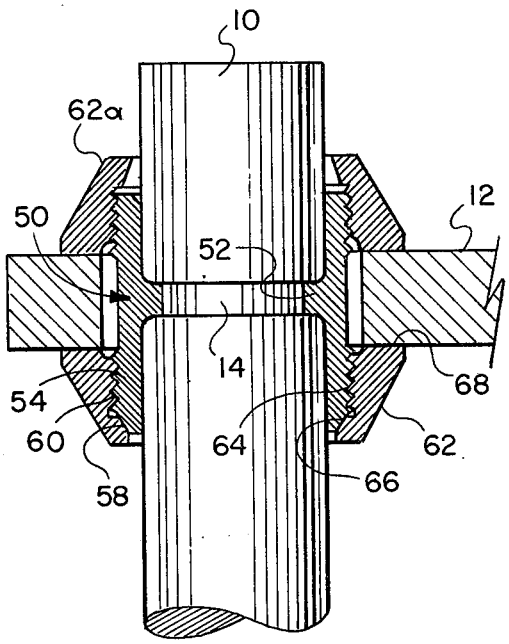
FIG. 5 is a fragmentary sectional view of an assembled shelf structure in accordance with this invention when taken as indicated by the arrows 5—5 of FIG. 4.

According to a further embodiment of the invention, there may be provided as shown in FIGS. 4 and 5 a modified collar 50 comprising collar parts 50*a* and 50*b*, each having an inner annular rib 52 and a lower skirt 54 with axially extending slits 56 formed therein.

In place of the wedge portions 28 and the ring 34 shown in FIGS. 2 and 3, there is provided a lower clamping ring 62 having internal threads 64 which engage external threads 60 on the skirts 54 of the collar pieces 50*a* and 50*b* so to hold the ribs 52 in any desired one of the post recesses 14.

The collar pieces 50*a* and 50*b* are also formed with downwardly and outwardly facing cam surfaces 58 for engagement with an inwardly and upwardly facing cam surface 66 so that, on tightening the ring 62, the collar skirts 54 are flexed inwardly into tight clamping engagement with the post 10.

The ring 62 is provided with an enlarged upper end 68 having a diameter greater then that of the shelf hole 16 and having a horizontal shelf-supporting top surface to provide positive support for such a shelf 12.

In this particular embodiment, the shelf-clamping means could be in the form of the ring 40 of the embodiment of FIGS. 2 and 3 but, in order to save tooling costs and to simplify inventory, it is possible to use for such a ring a further ring indicated at 62*a* and identical to the ring 62.

The operation of this embodiment is essentially the same as that of FIGS. 2 and 3. The collar pieces 50*a* and 50*b* are correctly positioned around the posts 10 and the lower rings 62 are screwed into position on the threads 60. The shelf 12 is then lowered into position and the upper rings 62*a* are finally screwed down. The rings 62 and 62*a* are usefully externally knurled or provided with other gripping means.

Figure 6:
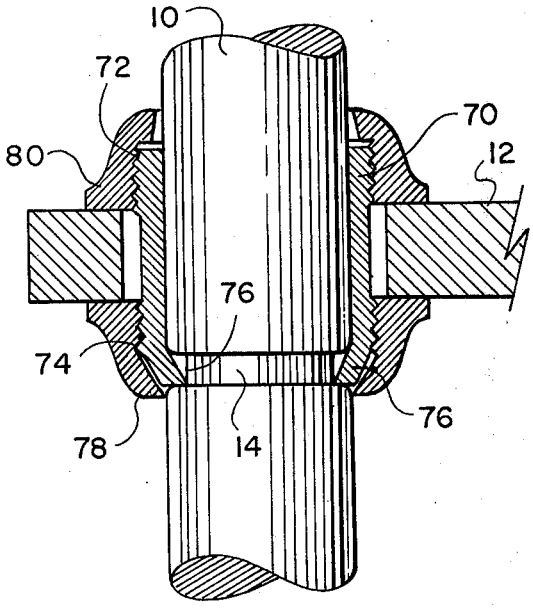
FIG. 6 is a fragmentary sectional view similar to those of FIGS. 3 and 5 but showing yet another embodiment of this invention.

In accordance with the further embodiment of the invention as shown in FIG. 6, there is provided a collar 70 which is somewhat similar to the collar 50 in that it is formed in two pieces and has upper and lower threads 72 and 74 respectively. Slits (not shown) corresponding to the slits 56 of the collar 50 are also provided in the lower end 76 of the collar 70.

The split lower end 76 of the collar 70 is inwardly flexible so that, on tightening of the lower ring 78, the flexible portion 76 is flexed inwardly into a desired one of the post recesses 14. Upper threaded rings 80 are also provided as in the embodiments previously described.

Figure 7:
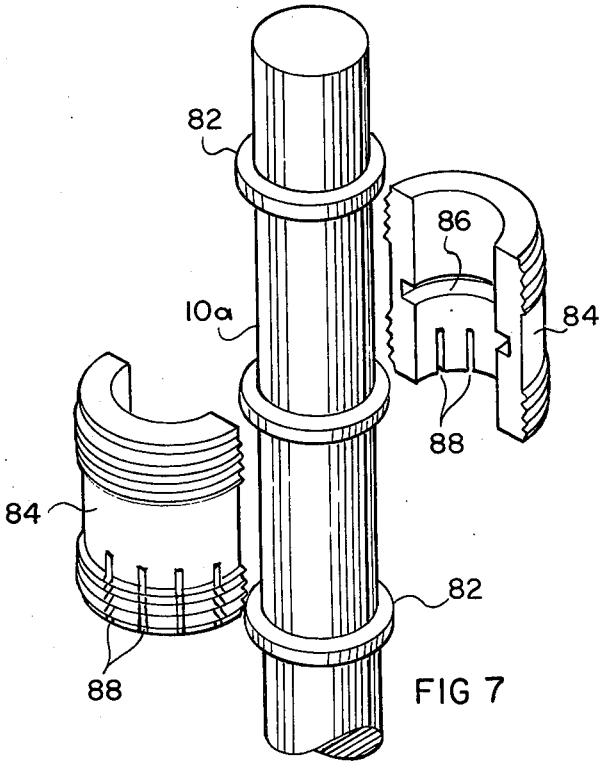
FIG. 7 is a fragmentary and exploded perspective view of a structural detail of yet another embodiment of a shelf structure in accordance with this invention.

Reference will now be made to FIG. 7 which shows yet a further embodiment of this invention. In that particular embodiment, the first abutment means as provided on shelf structure posts are in the form of radially outwardly projecting annular ribs 82 formed on posts indicated at 10*a* and a two-piece collar, only one piece of which is shown at 84, is provided with a corresponding internal annular recess 86 for receiving any desired one of the ribs 82. Slits 88 are provided at the lower end of the collar pieces 84.

The operation of this embodiment will be essentially the same as that of the embodiments already described with reference to FIGS. 2 to 5. Clearly, however, the size of the holes through the shelves 12 and though the upper and lower clamping rings (not shown) must be sufficient to allow the ribs 82 to pass therethrough so that both the shelves 12 and such rings can be slid downwardly along the posts and, as required, past the ribs 82 into the desired positions.

In accordance with a modification of the structure shown in FIG. 7, the collar pieces 84 may be clamped in position above any desired one of the ribs 82 so as simply to rest on the top surface of such rib.

It will be understood that numerous variations in and modifications of the structures hereinbefore specifically described are possible within the scope of this invention. For example, the upper ends of the posts 10 may be finished off with any suitable accessory as is well known in the art. For example, the fastening rings such as rings 40 as used at such post upper ends can be provided with some form of dome-like device so as to provide a structure having a more finished appearance but this is not thought to be necessary in the majority of cases.

It will also be appreciated that, while the posts 10 are shown as being provided with annular recesses or annular ribs having well-defined shapes, various modifications can be made in the shape of such abutment means without departing from the scope of the invention. Thus, such a post can be made so as to have an hourglass shape with alternate waists and bulges in a variety of different sculpted designs. Suitable modifications would then, of course, be made to the collars so that they could be used on such sculpted posts.

The foregoing is a description of several preferred embodiments of the invention and is given here by way of example only. The invention is not to be taken as limited to any of the specific features as herein described but comprehends all such variations thereof as come within the scope of the appended claims.

What is claimed is:

1. A shelf structure which comprises: a shelf including an opening;

a post extending freely through said opening and having a plurality of first abutment means mutually spaced apart and on said post; and a shelf-supporting and clamping means releasably engaged with said post and which in turn comprises:

a collar surrounding said post;

a second abutment means on said collar and engaging one of said plurality of first abutment means on said post whereby said collar is securely held in a fixed position relative to said post;

a fastening means removably encircling said collar so as to maintain said second abutment means and said one of said plurality of first abutment means in engagement with each other;

a shelf-supporting surface on said fastening means and in supporting juxtaposition with an undersurface of said shelf, and, a shelf-clamping means releasably abutting a top surface of said shelf to clamp said shelf between said clamping means and said fastening means.

2. A shelf structure as claimed in claim 1 and which comprises a plurality of said posts, each connected to said shelf by a said shelf-supporting and clamping means.

3. A shelf structure as claimed in claim 2 and which comprises at least three said posts.

4. A shelf structure as claimed in claim 3 and which comprises at least two said shelves, each of which is connected to each said post by a said shelf-supporting and clamping means.

5. A shelf structure as claimed in claim 4 and which comprises at least four said posts.

6. A shelf structure as claimed in claim 1, in which said collar is formed in at least two pieces adapted so as together generally to encircle said post and in which said fastening means is adapted releasably to hold said pieces of said collar in an assembled configuration thereof with said second abutment means engaging said one of said plurality of first abutment means.

7. A shelf structure as claimed in claim 6 and in which said shelf-clamping means comprises an internally threaded annular member screwed downwardly on said collar into clamping engagement with said shelf.

8. A shelf structure as claimed in claim 7 and in which each said piece of said collar is split in an axial direction upwardly from a lower end thereof to permit its radially inward flexing into tight clamping engagement with said post on assembly of said shelf structure.

9. A shelf structure as claimed in claim 8 and in which said fastening means comprises a ring having a said shelf-supporting surface and a downwardly and inwardly facing cam surface adapted to cooperate with upwardly and outwardly facing cam surfaces on said pieces of said collar so as to urge said pieces radially inwardly for said clamping engagement of said collar with said post.

10. A shelf structure as claimed in claim 8, in which said fastening means comprises an internally threaded annular member having a said shelf-supporting surface and in which said pieces of said collar are externally threaded generally at lower ends thereof so that said fastening means can be screwed upwardly on and about said pieces of said collar to urge those pieces radially inwardly for said clamping engagement with said post.

11. A shelf structure as claimed in claim 8, in which each said first abutment means is in the form of an annular peripheral groove in said post and in which said second abutment means comprises a cooperating annular rib projecting radially inwardly from at least one said piece of said collar.

12. A shelf structure as claimed in claim 8, in which each said first abutment means is in the form of an annular radially outwardly projecting rib on said post, and in which said second abutment means comprises a cooperating internal annular recess in said pieces of said collar.

13. A shelf-structure as claimed in claim 8, in which each said first abutment means is in the form of an annular peripheral groove in said post, in which said collar comprises a skirt having a lower flexible portion engageable in said annular peripheral groove, and in which releasable mutual engagement of said fastening means and said collar causes said lower flexible portion to be so urged into said groove.

14. A shelf structure as claimed in claim 13 and in which said fastening means is in the form of an internally threaded member removably screwed upwardly onto said collar and comprising a said upwardly facing shelf-supporting surface.

15. A shelf structure as claimed in claim 14 and in which said shelf-clamping means comprises an internally threaded annular member screwed downwardly on said collar into clamping engagement with said shelf.

* * * * *